US005542863A

United States Patent [19]

Brian et al.

[11] Patent Number: 5,542,863

[45] Date of Patent: Aug. 6, 1996

[54] WATER VEHICLE JET PUMP FLOW CONTROL APPARATUS

[76] Inventors: Frank J. Brian, 3701 Ahern, Baldwin Park, Calif. 91706; Gary M. Burrow, 6811 Salt Lake Ave., Bell, Calif. 90201

[21] Appl. No.: 225,451

[22] Filed: Apr. 6, 1994

[51] Int. Cl.[6] ..... B63H 11/10

[52] U.S. Cl. ..... 440/47; 239/546

[58] Field of Search ..... 440/47, 38; 415/148; 60/221, 222; 239/546, 265.43

[56] References Cited

U.S. PATENT DOCUMENTS

| | | | |
|---|---|---|---|
| 2,149,155 | 4/1938 | Anderson . | |
| 2,693,078 | 11/1954 | Laucher | 239/546 X |
| 3,141,439 | 2/1962 | Liston | 440/47 |
| 3,163,980 | 1/1965 | Turner | 440/47 |
| 3,214,903 | 11/1965 | Cochran . | |
| 3,279,704 | 10/1966 | Englehart et al. . | |
| 3,286,641 | 11/1966 | Delao et al. . | |
| 3,424,121 | 1/1969 | Thomas et al. . | |
| 3,448,713 | 6/1969 | Thomas et al. . | |
| 3,534,908 | 10/1970 | Coleman et al. | 239/265.43 |
| 3,772,886 | 11/1973 | Cameron | 60/221 |
| 3,942,463 | 9/1976 | Johnson, Jr. et al. | 440/47 |
| 3,977,353 | 8/1976 | Toyama | 440/38 |
| 4,316,721 | 2/1982 | Weiss et al. | 440/47 |
| 4,373,919 | 2/1983 | Stangeland | 440/47 |
| 4,775,341 | 10/1988 | Tyler et al. | 440/47 |
| 5,244,425 | 9/1993 | Tasaki et al. | 440/47 |

FOREIGN PATENT DOCUMENTS

| | | | |
|---|---|---|---|
| 1050965 | 10/1983 | U.S.S.R. | 440/47 |

*Primary Examiner*—Sherman Basinger
*Attorney, Agent, or Firm*—William W. Haefliger

[57] ABSTRACT

In jet pump liquid flow control apparatus the combination comprising an annular body and a liquid flow passage through the body, the passage defining a longitudinal axis; an annular series of flow controlling elements spaced about the axis with successive of the elements having primary portions extending in edge overlapping relation whereby the elements define a flow controlling section of the passage; and control means extending about the axis for controllably urging the primary portions of elements toward the axis thereby to control the cross sectional area of the passage sections.

10 Claims, 4 Drawing Sheets

WATER VEHICLE JET PUMP FLOW CONTROL APPARATUS

BACKGROUND OF THE INVENTION

This invention relates generally to jet propulsion of water vehicles such as boats, jet skis, and the like; more particularly it concerns improved control of water velocity discharge from propulsion means.

There is need for simple, rugged, low-cost, easily replaceable flow control apparatus for motor vehicles as referred to. It is believed that no prior apparatus embodies the multiple and unusual advantages in construction, mode of operation, and results, as will be described herein.

SUMMARY OF THE INVENTION

It is a major object of the invention to provide improved flow control apparatus meeting the above needs. Basically, the apparatus includes a) an annular body and a liquid flow passage through the body, the passage defining a longitudinal axis, b) an annular series of flow controlling elements spaced about the axis with successive of the elements having primary portions extending in edge overlapping relation whereby the elements define a flow controlling section of the passage, c) and control means extending about the axis for controllably urging the primary portions of elements toward the axis thereby to control the cross sectional area of the passage sections.

Another object is the provision of a series of pushers located about the central axis outwardly of the flow control elements and controllably movable toward that axis to simultaneously displace said primary portions of the elements toward the axis.

Yet another object is the provision of a control actuator rotatable about the axis to variably displace the pushers toward the axis. Each pusher typically has pivoted support relative to the body at a first location and has pivoted connection to the actuator at a second location, the first and second locations spaced about the axis.

A further object includes the provision of a series of pushers, each of which has opposite sides spaced apart in the direction of the axis, the first pivot location positioned at one of the pusher sides, and the second pivot location positioned at the other of the pusher sides. Each such first location is typically fixed relative to the body and the second location is bodily movable relative to the body, the first and second locations spaced outwardly of the elements. Iris-like closing movement of the pushers results.

An additional object includes the provision of a series of flow control elements adapted to be displaced by pushers as referred to, the elements having beveled surface, sliding inter-engagement as the elements are displaced toward the axis by the pushers. Such elements also have secondary portions that are anchored relative to said body, said primary portions extending downstream of the secondary portions, relative to the direction of liquid flow through the main passage.

These and other objects and advantages of the invention, as well as the details of an illustrative embodiment, will be more fully understood from the following specification and drawings, in which:

DRAWING DESCRIPTION

FIG. 4(*b*) shows the pushers in a closed position;

FIG. 4(*c*) is an enlarged section to show edge overlap;

DETAILED DESCRIPTION

Figure 1:
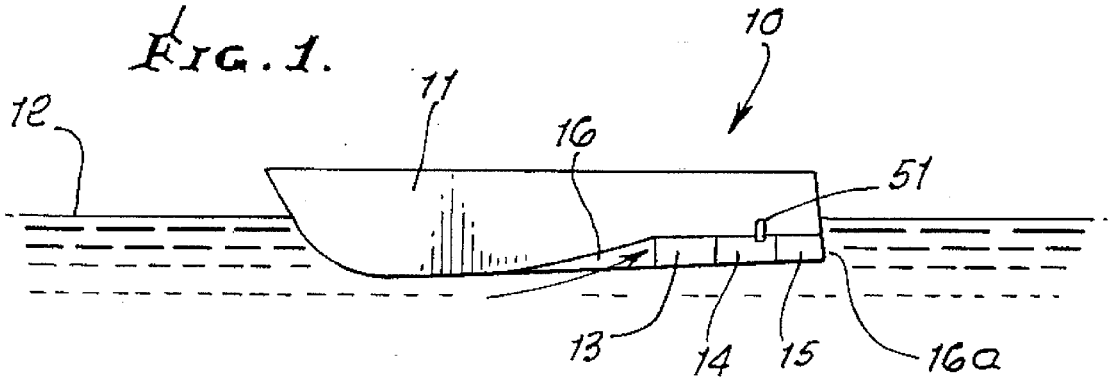
FIG. 1 is an elevation showing a water vehicle or craft.

In FIG. 1, a water vehicle 10 has a hull 11 shown moving forwardly (leftwardly) in a water body 12. The hull may be that of a jet ski, a boat, or other type vehicle. Flow control apparatus 14, to be described herein, is shown connected between a flow propelling unit 13, and a flow directing unit 15. These devices 13–15 define a sequence of flow paths between intake 16 and discharge 16*a*. The function of the unit 13 is to propel the flow rearwardly into the apparatus 14, and unit 13 may include a motor driven propeller. See for example U.S. Pat. No. 5,244,425 and U.S. Pat. No. 3,279,704. The function of apparatus 14 in accordance with the herein invention is to control the flow, i.e. to control the velocity of the flow discharged rearwardly; and the function of the unit 15 is to control the vector direction of the rearwardly discharging flow, relative to vehicle 10, as for example to controllably effect turning of the vehicle. Unit 15 may be swiveled relative to unit 14, or about a vertical axis.

Figure 2:
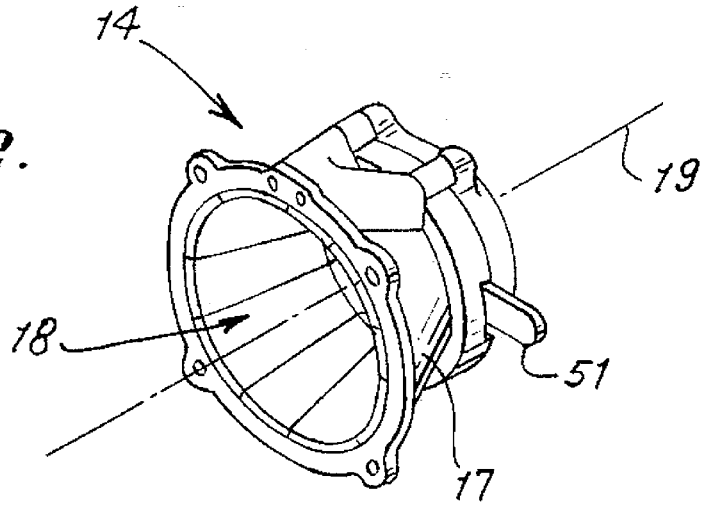
FIG. 2 is a perspective view of the exterior of flow control apparatus.
Figure 7:
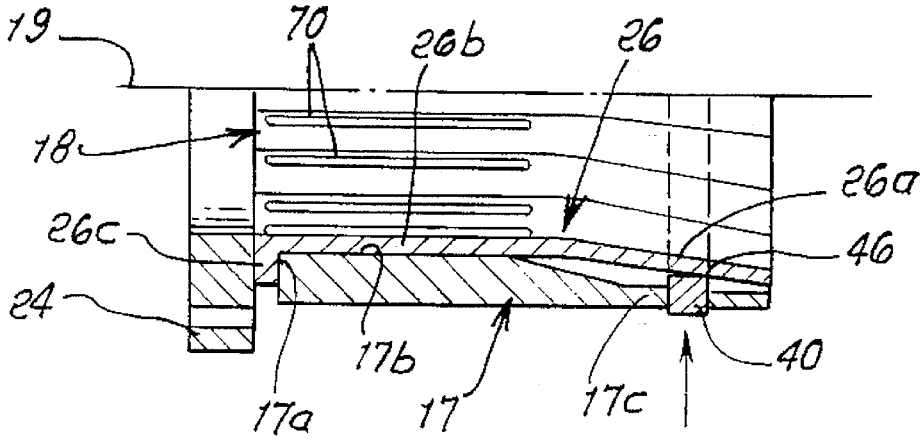
FIG. 7 is an axial radial section taken through the FIG. 2 apparatus showing certain of the flow control elements, in modified position, their retention and relation to a pusher.
Figure 3:
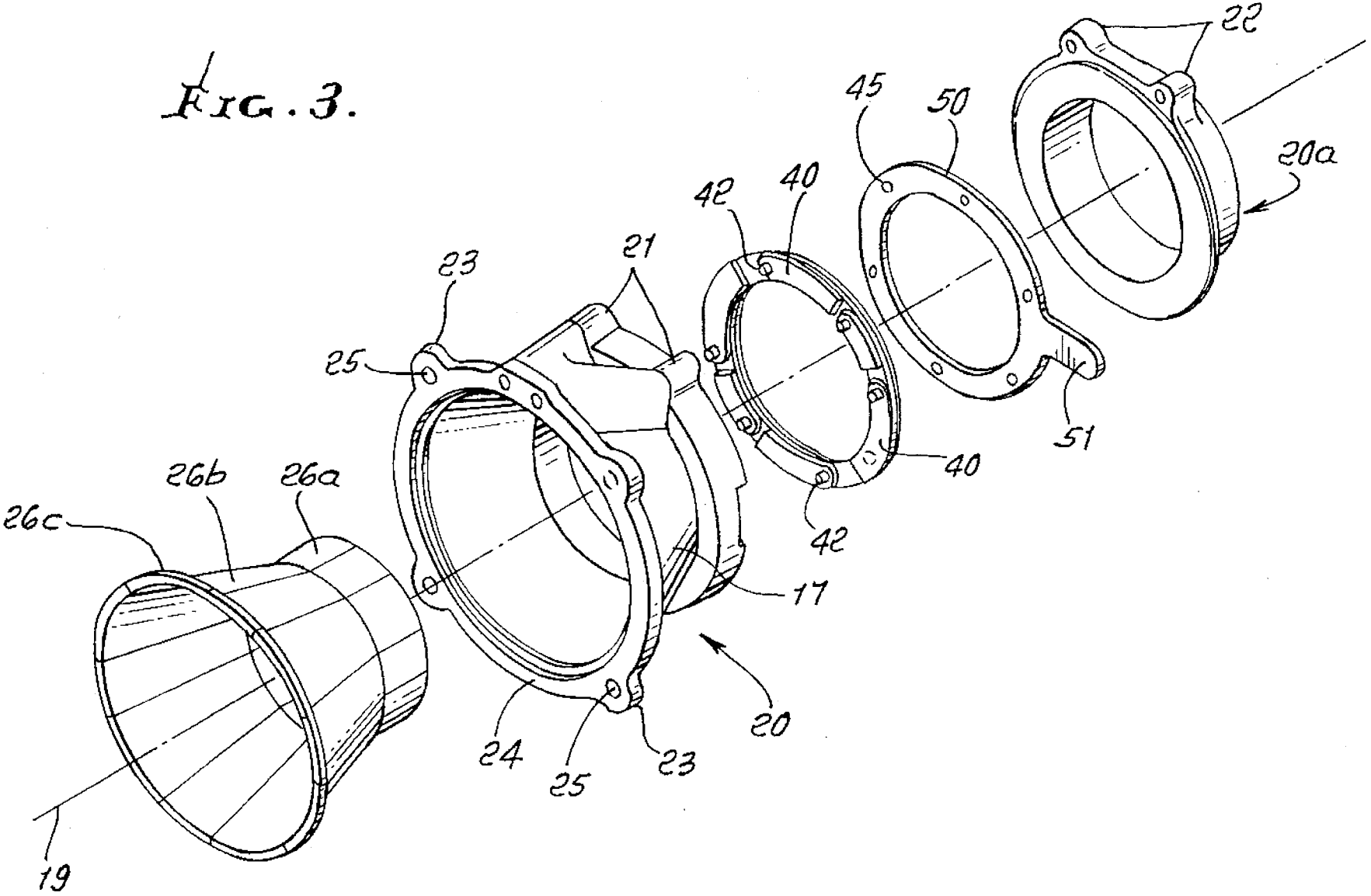
FIG. 3 is an exploded perspective view of the FIG. 2 apparatus.

As shown in FIGS. 2, 3 and 7, the apparatus 14 includes an annular body 17 containing a liquid flow passage 18, the latter defining a longitudinal axis 19. The body may advantageously include a main forward housing 20, and a rear housing 20*a*, there being aligned lugs 21 and 22 on these housings to receive fasteners for holding the housings in axially assembled relation. Lugs 23 on the forward flange 24 of housing 20 define openings 25 to receive fasteners to connect to unit 13, for example. Thus, the apparatus 14 can be easily installed, and removed for replacement, as needed, due to wear.

Figure 4A:
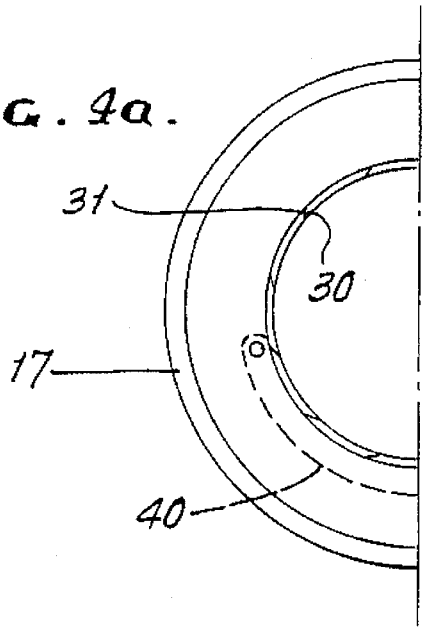
FIG. 4(*a*) shows the pushers in an open position.
Figure 4B:
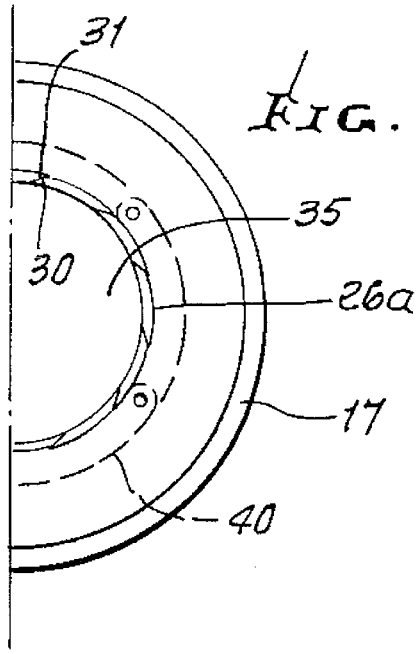
Figure 4C:
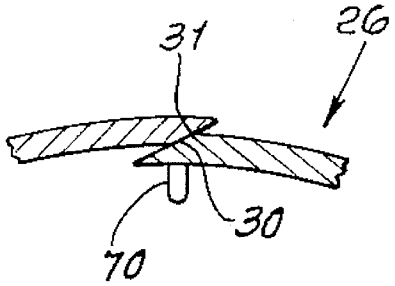

Extending the description to FIGS. 4(*a*)–4(*c*), an annular series or sequence of flow controlling elements is provided. Such elements 26 are spaced about axis 19, and may take the form of thin plate-like segments which are elongated in the direction of axis 19. The elements have primary portions 26*a* located downstream of secondary portions 26*b*. The latter flare forwardly and have outwardly turned ends 26*c* retained between annular flange 24 and body 17 seen in FIG. 3. Portions 26*a* extend adjacent body inner wall 17*b* (see FIG. 7 for reference numeral 17*b*), and portions 26*a* extend generally parallel to axis 19, as shown, inwardly of body annular extent 17*c* (see FIG. 7 for reference numeral 17*c*). The elements or segments 26*b* edge overlap one another at all times, as at inward and outward facing beveled edges 30 and 31 seen in FIGS. 4(*b*) and 4(*c*). The overlap is relatively greater when the primary portions 26*a* lie closer to axis 19 to define a smaller cross section passage, as in FIG. 4(*b*) and is relatively lesser when the elements or segment portions 26*a* lie further from the axis 19, to define a larger cross section flow passage, as in FIG. 4(*a*). Such elements typically consist of molded plastic material, and are subject to wear as sand or grit flows through the flow passage at high velocity; however, the unit 14 is easily replaced between units 13 and 15, as referred to above. Since the elements consist of molded plastic material, they are much easier to deflect inwardly than elements made of metal would be.

Control means is provided to extend about axis 19 for controllably urging (i.e. deflecting) the primary portions 26*a* of the elements 26 toward that axis, thereby to control the cross sectional area of the flow passage in 14, and indicated at 35 in FIGS. 4(*b*) and 7. As shown, the control means is localized close to the elements 26, whereby need for extensively exteriorly projecting control structure is eliminated. Such control means includes a series of pushers 40 located about axis 19 outwardly of said elements, and controllably movable toward that axis to simultaneously displace the primary portions 26*a* of the elements toward axis 19. Each iris-like pusher curves part way about axis 19, its inner surface 40*a* having curvature approximately matching the outer surface curvature of the segments 26.

Figure 6:
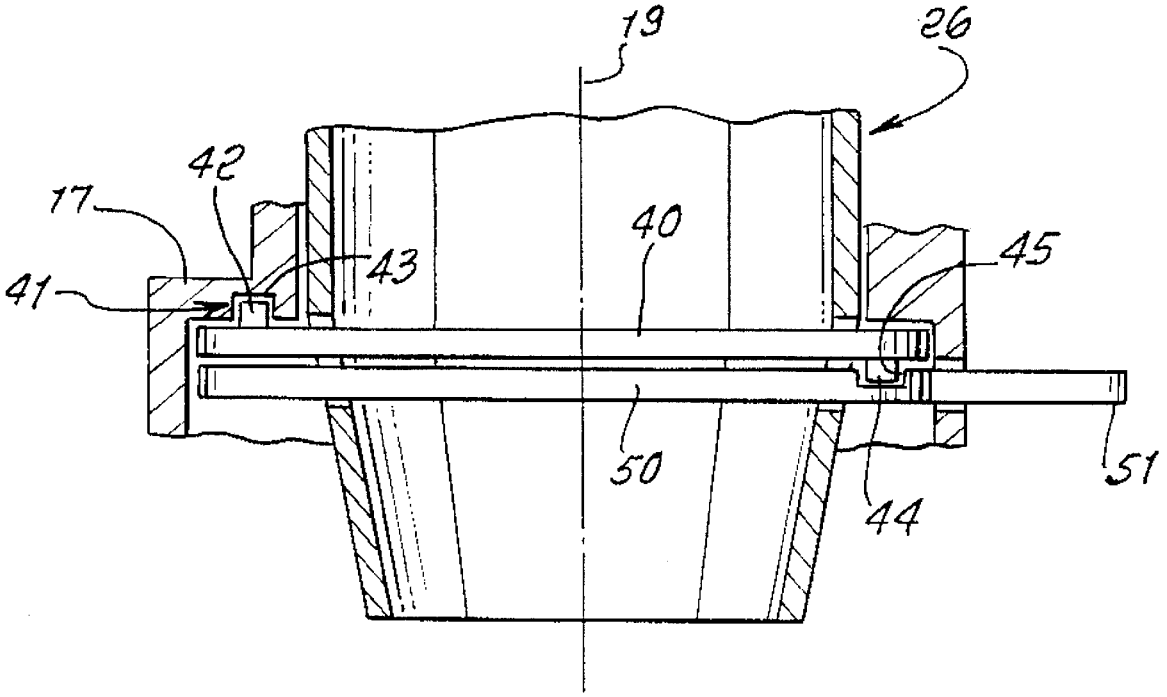
FIG. 6 is a view like FIG. 5, but showing the pusher in position for pivoting, in the flow control apparatus.
Figure 5:
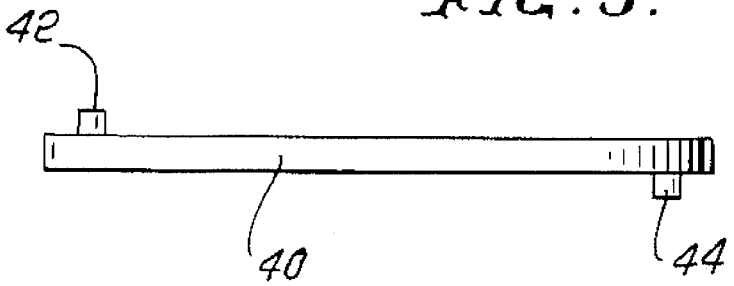
FIG. 5 is a plan view of one of a circular series of iris type pushers used to displace the flow control elements.

As shown in FIGS. 5 and 6 the pusher has pivoted support at 41 relative to the body 17 at a first location, as may be provided by a pivot post or trunnion 42 integral with one side of the pusher at an end thereof and received in a pivot recess or socket 43 in the body. The pusher also has pivoted connection to an annular actuator 50 rotatable about the axis 19 as by manipulation of a projecting handle 51 on the actuator. Note the lug or post 44 integral with the opposite side of the pusher at the opposite end thereof, and received in a pivot recess or socket 45 in the actuator at a second location. The first and second locations of the respective lugs or posts 42 and 44 are spaced about axis 19, and the series of first locations associated with the posts 42 of the series of pushers are spaced apart about axis 19 at equal intervals.

Figure 8:
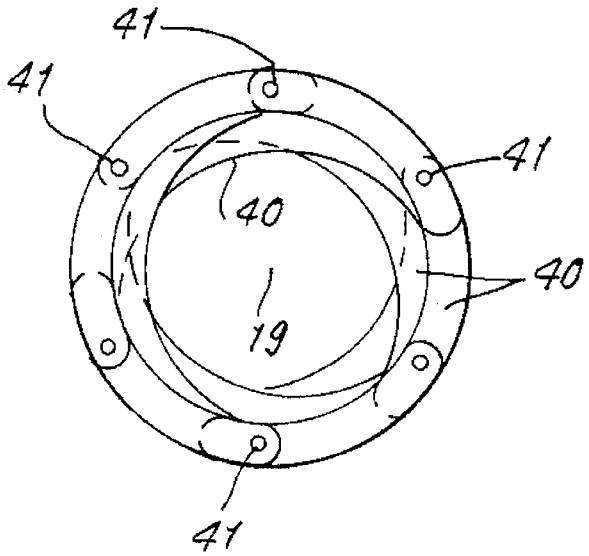
FIG. 8 is a schematic axial view showing a circular series of the pushers, in "closed" position.
Figure 9:
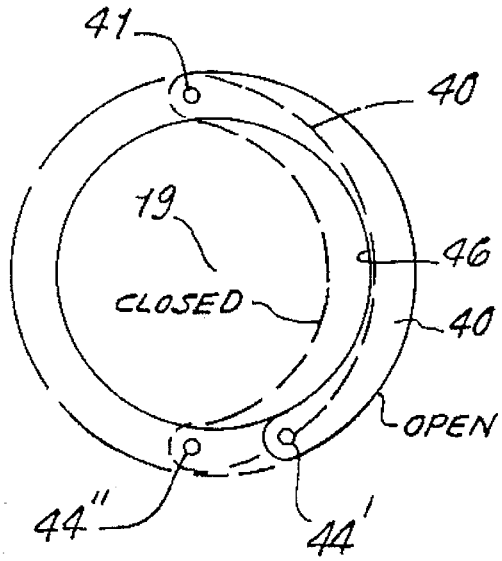
FIG. 9 is a view like FIG. 8, but showing open and closed positions of one pusher.

As viewed in FIG. 6, the second post 44 is located in clockwise relation from the first post 42. As the actuator ring is rotated about axis 19, the ends of the pushers associated with posts 44 are displaced as in FIG. 9, as from positions 44' to 44" whereby the inward facing surface 46 of the pusher 40 moves toward axis 19, displacing the petal-like element 26*a* adjacent thereto in an inward direction. The opposite end of the pusher hinges at fixed first location 42. FIG. 8 shows the assembly of pushers displaced inwardly to displace the elements 26 inwardly, reducing the cross sectional area of the flow passage, and increasing the velocity of water flow through that cross-section, to vary the jet thrust propelling the water velocity. See also FIG. 4(*b*).

FIGS. 2 and 7 show that the rotary actuator ring 50 lies close to the body or casing 17, only the control handle projecting outwardly. That handle can be manually operated, or operated by additional mechanism, such as a worm or linear actuator. The elements 26 or 40 have memory, whereby they tend to return to their outermost positions, as seen in FIG. 7, as the actuator ring is rotated counterclockwise.

FIGS. 4(*c*) and 7 also show the use of flow guide vanes 70 that are attached to or integral with the respective elements 26, i.e. at forward portions thereof that maintain, substantially, the flow area. Vanes 70 project inwardly and also extend rearwardly, as shown, and they are located proximate the overlap extents of the elements 26, as seen in FIG. 4(*c*).

FIG. 7 may be regarded as a form of the apparatus, with parts 26*b* and 26*a* positioned more radially outwardly than in FIG. 3.

We claim:

1. In jet pump liquid flow control apparatus the combination comprising:

a) an annular body and a liquid flow passage extending rearwardly through the body, the passage defining a longitudinal axis, b) an annular series of flow controlling elements spaced about said axis with successive of said elements having primary portions extending in edge adjacent relation whereby the elements define a flow controlling section of said passage, c) and control means extending about said axis for controllably urging said primary portions of said elements toward said axis thereby to control the cross sectional area of said passage section, d) said elements formed as plates which flare forwardly, successive of said primary portions having beveled surface overlap with sliding interengagement as the primary portions are displaced toward said axis in response to said urging, said beveled surface overlap increasing on all of said primary portions as they are displaced toward said axis.

2. The combination of claim 1 wherein said control means includes a series of pushers extending arcuately about said axis outwardly of said elements and controllably movable toward said axis to simultaneously displace said primary portions of the elements toward said axis.

3. The combination of claim 2 wherein said control means includes an actuator rotatable about said axis to variably displace the pushers toward said axis.

4. The combination of claim 3 wherein each pusher has pivoted support relative to said body at a first location and has pivoted connection to said actuator at a second location, said first and second locations spaced about said axis.

5. The combination of claim 4 wherein the first locations associated with the series of pushers are spaced apart about said axis, and the second locations associated with the pushers are spaced apart about said axis, the second location associated with each pusher located in clockwise spaced relation from the first location associated with that pusher.

6. The combination of claim 5 wherein said actuator comprises a ring extending about said pushers and rotatable about said axis.

7. The combination of claim 5 wherein each pusher has opposite sides spaced offset in the direction of said axis, said first location positioned at one of said pusher sides, and said second location positioned at the other of said pusher sides.

8. The combination of claim 7 wherein said first location is fixed relative to said body and said second location is bodily movable relative to said body, said first and second locations spaced outwardly of said elements.

9. The combination of claim 1 wherein said elements have secondary portions that are anchored relative to said body, said primary portions extending downstream of said secondary portions, relative to the direction of liquid flow through said passage.

10. The combination of claim 9 including flow guide vanes integral with said primary portions, proximate edges of adjacent said elements.

* * * * *